US006662807B2

(12) United States Patent
Meinschewnk

(10) Patent No.: US 6,662,807 B2
(45) Date of Patent: Dec. 16, 2003

(54) NAIL JACKETS

(76) Inventor: Paul Meinschewnk, 11 Yorkville Avenue, Suite 903, Toronto, Ontario (CA), M4W 1L1

( * ) Notice: Subject to any disclaimer, the term of this patent is extended or adjusted under 35 U.S.C. 154(b) by 0 days.

(21) Appl. No.: 09/803,890

(22) Filed: Mar. 13, 2001

(65) Prior Publication Data

US 2001/0037814 A1 Nov. 8, 2001

(30) Foreign Application Priority Data

Mar. 31, 2000 (CN) ..... 89106045 A

(51) Int. Cl.[7] ..... A45D 29/00
(52) U.S. Cl. ..... 132/200; 132/73
(58) Field of Search ..... 132/285, 73, 73.5, 132/200; 2/163, 167, 161.3, 159, 161.1

(56) References Cited

U.S. PATENT DOCUMENTS 667,338 A * 2/1901 Rogers ..... 132/73
1,306,442 A * 6/1919 Sansotta ..... 132/73
3,887,286 A * 6/1975 Bucey ..... 401/7
4,960,138 A * 10/1990 Kling ..... 132/73
4,972,857 A * 11/1990 Stewart et al. ..... 132/73
5,085,234 A * 2/1992 Silverman ..... 132/73
D329,923 S * 9/1992 Thaxton ..... D28/56
5,186,189 A * 2/1993 Harris ..... 132/285
6,302,116 B1 * 10/2001 Copeland ..... 132/73
6,536,444 B1 * 3/2003 Chung ..... 132/200

* cited by examiner

*Primary Examiner*—John J. Wilson
*Assistant Examiner*—Robyn Kieu Doan

(57) ABSTRACT

The present invention describes a releasably attachable ultra violet light blocking shield preferably in the shape of a cup or closed end tip that envelops the wearer's finger(s) from the base of the nail to the tip of the artificial or natural nail; which purpose is to protect the wearer's artificial and or natural nails from yellowing due to exposure to the Ultra-violet light from artificial or natural sunlight. It is and can be composed of rubber, plastic, latex, foam, metal, wood, paper or any other such materials that are impenetrable by UV light. It is made of pliable materials is easily assembled and is readily stored.

1 Claim, 15 Drawing Sheets

NAIL JACKETS

FIELD OF THE INVENTION

The present invention relates to nail protectors which purpose is to protect artificial and natural nails from yellowing due to exposure to natural and artificial light.

BACKGROUND OF THE INVENTION

Heretofore, it was known in prior art to provide fingernail protectors. Some previously recognized problems were that nails were exposed to breaking, chipping, dirt, etc. when the nails were exposed to household chores and trying to dry after a manicure etc. But none specifically address protection of artificial and natural nails from yellowing due to Ultraviolet light whether it be from artificial light from suntan (beds) studios or the sun itself.

The below referenced US patents disclose embodiments that were at least in part satisfactory for the purposes for which they were intended but had certain disadvantages. The disclosure of all the below referenced prior US patents in their entireties are hereby expressly incorporated by reference into the present application for purposes including but not limited to, indicating the background of the present invention and illustrating the state of the art.

U.S. Pat. No. 5,699,816 discloses a device to protect the wearers nail as it is drying from a manicure/polish.

U.S. Pat. No. 3,967,631 discloses a fingernail cap but its function is limited to protecting fingernail(s) from dirt, breaking etc. from household chores while maintaining tactile sensitivity.

U.S. Pat. No. 5,121,760 discloses a device to protect the wearers nail as it is drying from a manicure/polish.

U.S. Pat. No. 4,665,934 discloses a device to protect the wearers nail as it is drying from a manicure/polish.

U.S. Pat. No. 5,540,243 discloses a finger protector which primary function is to maintain tactile sensitivity.

U.S. Pat. No. 4,089,066 discloses a device to protect the wearers nail as it is drying from a manicure/polish.

SUMMARY OF THE INVENTION

In one of its more specific aspects the present invention is directed to an apparatus that protects each artificial and natural nail from yellowing due to exposure to ultraviolet light from suntan studios and the sun itself. It is of simple construction and may be readily manufactured and in operation embodies a different principle than any previously known device or similar structure for protecting artificial and natural nails from harmful exposures.

This invention relates specifically to an ultraviolet light blocking shield, which is releasably attachable on users nail to protect artificial and natural nails from yellowing caused by exposure to ultraviolet light normally acquired through suntan studios or the sun itself. In a preferred embodiment the shield comprises a frame with a cylinder type shape that forms a cup, which outlines and encompasses the terminal phalanx of the human finger.

The shield is placed over the nails and is held snug by the nature of the material and fit over the fingers.

The shield is self-sustaining, can be put on without any special care in a single action, and can be removed by pulling off in an easy manner.

BRIEF DESCRIPTION OF THE DRAWINGS

Preferred embodiments of the present invention are shown in the drawings, wherein:

FIG. 26: Illustrates an embodiment of a nail jacket that is held together by a web so that the nail jacket is easy to transport and put on.

DETAILED DESCRIPTION OF THE PREFERRED EMBODIMENTS

The Nail Jacket according to the present invention is designed to protect artificial and natural nails from yellowing or discoloration during exposure to ultraviolet light typically found in suntan (beds) studios and from the sun itself. The Nail Jacket is preferably lightweight and somewhat decorative.

The present disclosed Nail Jacket works especially well when the Nail Jacket is placed over the artificial and or natural nail, preventing the nails from yellowing by shielding the nail from ultraviolet exposure be it artificial or natural light.

The present Nail Jacket according to the present invention is not limited to where it can be used or for how long it can be used.

As shown in the attached figures the Nail Jacket comprises of: a releasably attachable ultra violet light blocking shield preferably a cup or shield or other design which envelops the wearer's artificial and or natural nail and which is, held on snug by the nature of the material itself or due to the design of the invention.

Figure 1:
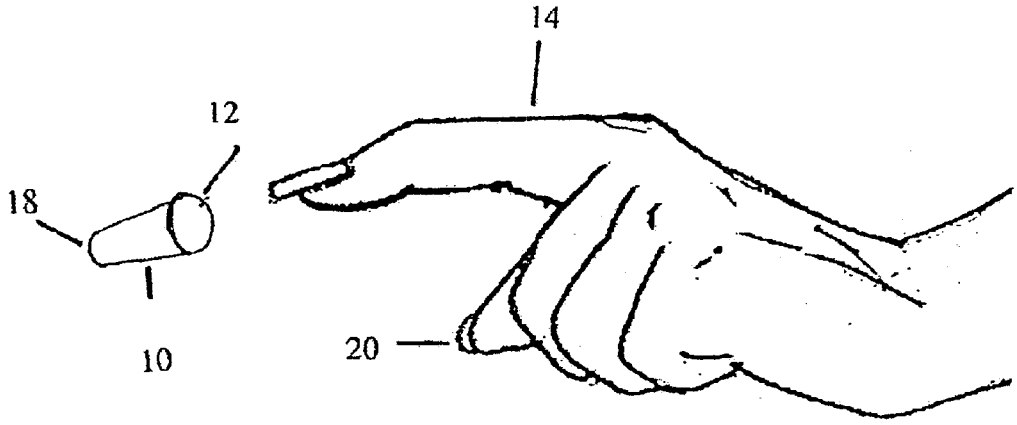
FIG. 1: Is a perspective view of a first embodiment nail jacket of the first invention.
Figure 2:
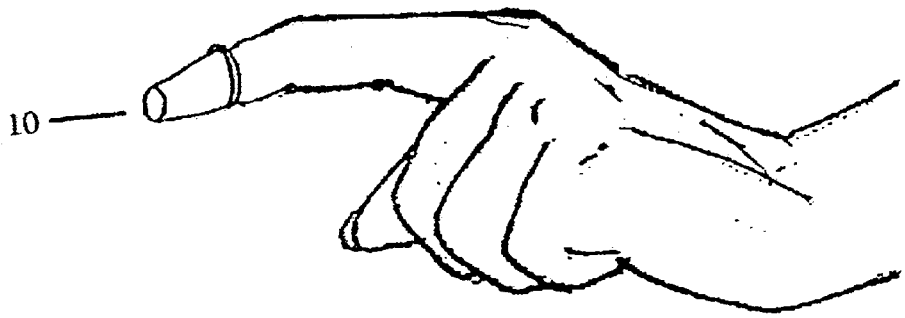
FIG. 2: Is a perspective view of the nail jacket of FIG. 1 covering an artificial and or natural fingernail.

As illustrated in FIGS. 1 and 2, in one embodiment, the nail jacket 10 has a cup shape with an open end 12 and a closed end 18. In nail jacket 10 fits over and covers the fingernail 16 of the finger 14 of a user by inserting the fingernail into the interior of the nail jacket 10. In this way, the nail is enveloped within the nail jacket and shielded from the effects of ultra violet light.

Figure 3:
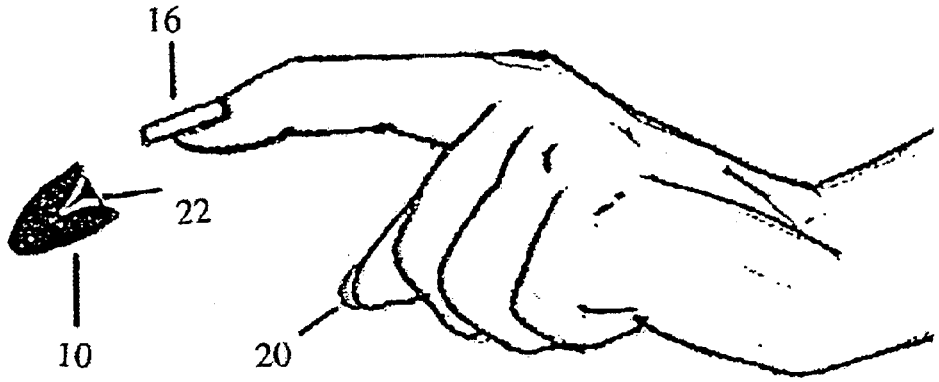
FIG. 3: Is a perspective view of a second embodiment of a nail jacket of the present invention.
Figure 4:
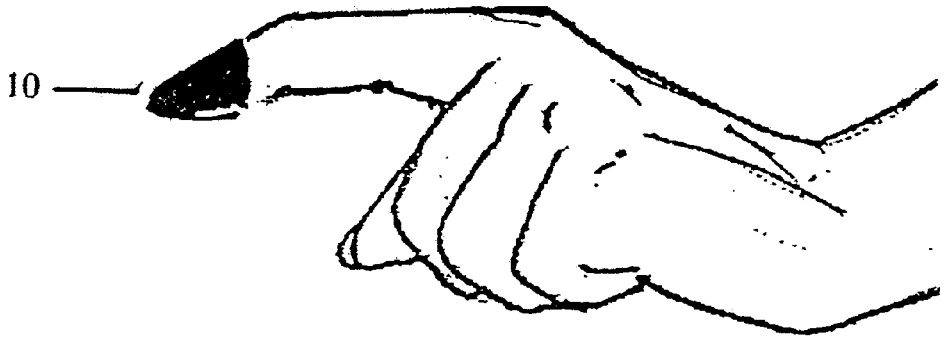
FIG. 4: Is another embodiment of the nail jacket whereby the jacket is composed of a thimble like structure that envelops the terminal phalanx of the finger.

FIGS. 3 and 4 illustrate a second embodiment of a nail jacket of the present invention. This nail jacket 10 is a thimble like structure that envelops the terminal phalanx of the user's finger.

Figure 5:
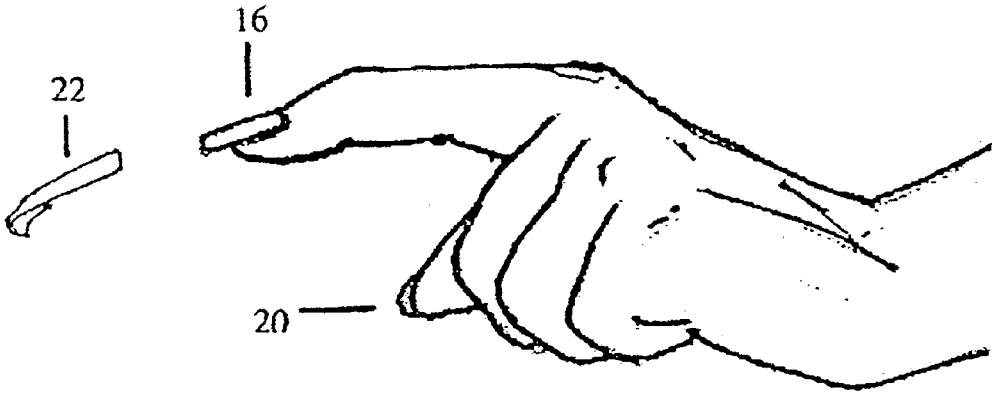
FIG. 5: It is a perspective view of a further embodiment of a nail jacket of the present invention.
Figure 6:
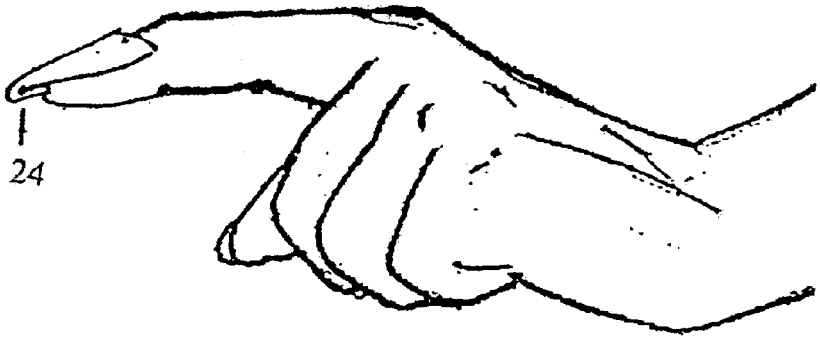
FIG. 6: Illustrates the nail jacket of FIG. 5 fits over the top of the users nail and envelopes the underside of the users nail.

FIGS. 5 and 6 illustrate yet another embodiment of a nail jacket which is adapted to fit over the user's nail 16. This embodiment has a top surface 22 to cover the user's nail and a bottom clip 24 which engages the under surface of the user's nail to hold the nail jacket in place.

Figure 7:
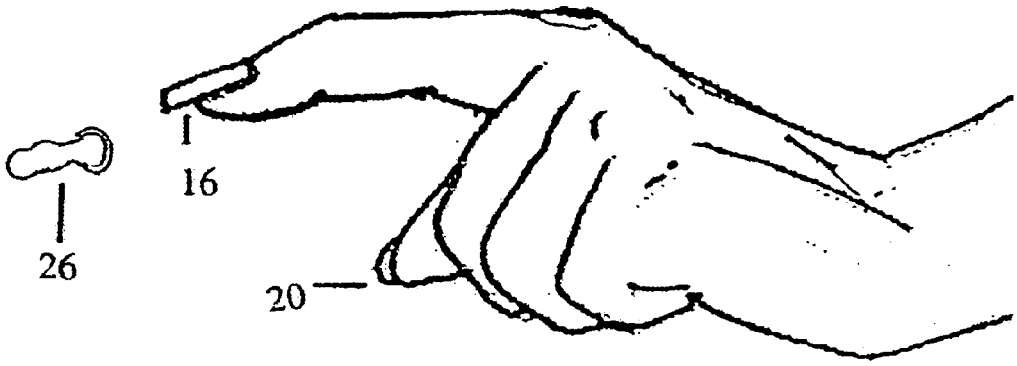
FIG. 7: Is a perspective view of a further embodiment of a nail jacket of the present invention of Latex material that slides over the users nail.
Figure 8:
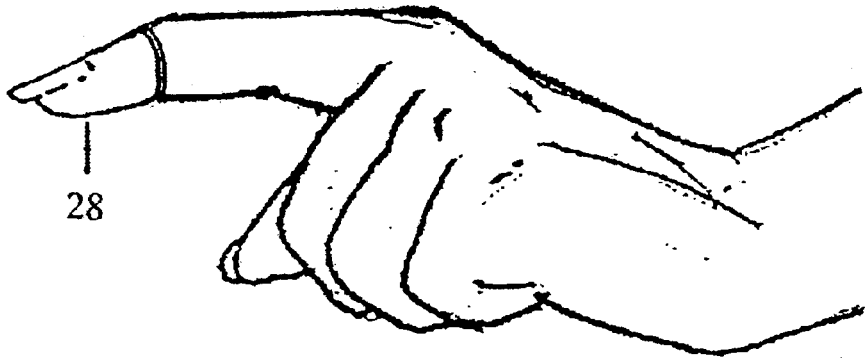
FIG. 8: Illustrates the Latex nail jacket for FIG. G over the users nail protecting it from UV light.

FIGS. 7 and 8 illustrate yet another embodiment of a nail jacket of the present invention. This nail jacket is constructed of a expandable material, such as latex, which slips over the end of a user's finger and covers the nail to protect. The expandable material such as the latex, may be coloured to a suitable colour and include UV blockers for blocking the UV light and reaching the user's nail.

Figure 9:
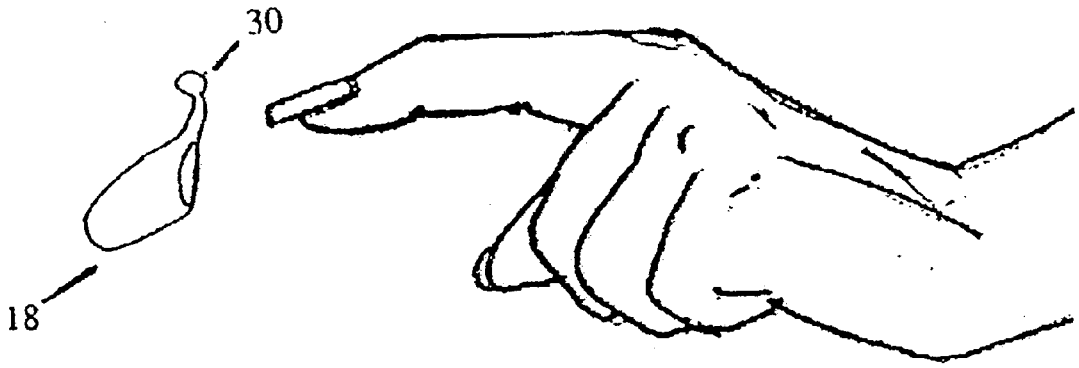
FIG. 9: Is a perspective view of a further embodiment of a Nail Jacket of the present invention.
Figure 10:
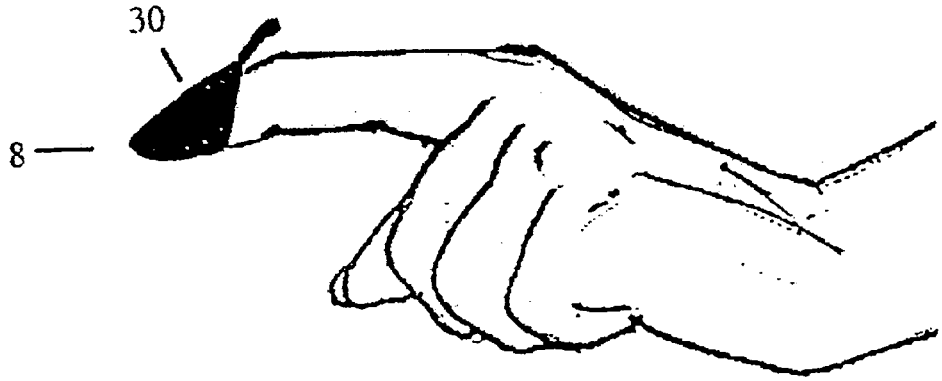
FIG. 10: Is a perspective view of a further embodiment of a nail jacket of cylindrical design which forms a cup at the end protecting the nail from UV light.

FIGS. 9 and 10 illustrates yet a further embodiment of a nail jacket of the present invention, being of cylindrical shape for encasing the user's finger. This embodiment has a handle means 30 to aid in pulling the nail jacket over the end of the finger and removing it from the finger.

Figure 11:
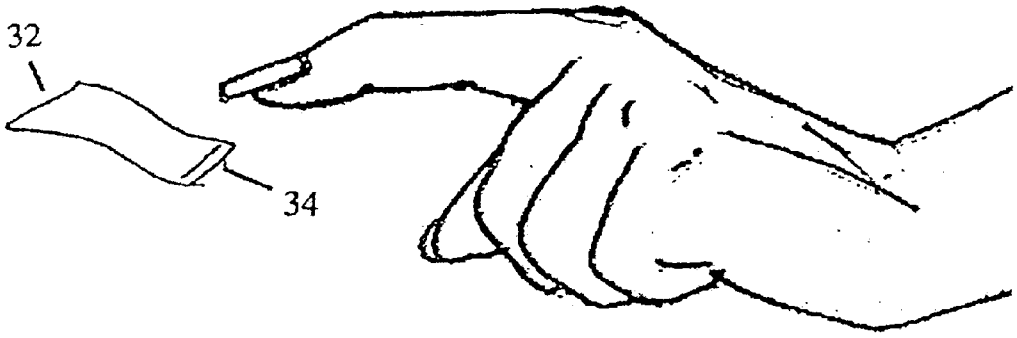
FIG. 11: Is a perspective view of a further embodiment of a Nail Jacket of the present invention.
Figure 12:
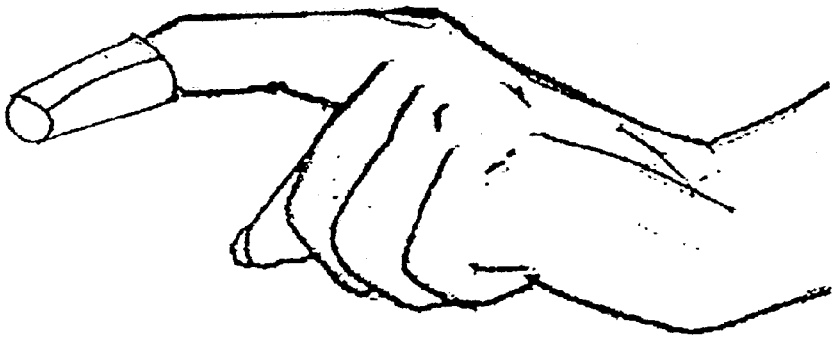
FIG. 12: Illustrates a further embodiment of a nail jacket of paper design which wraps around the tip of the users finger and is held together by an adhesive which binds the tips of the paper together so as to form an cylinder that shields the users nail.

FIGS. 11 and 12 illustrates yet a further embodiment of a nail jacket of the present invention which is a paper design which wraps around the tip of the user's finger and is held together by an adhesive which binds the tips of the paper together so as to form a cylinder that shields the user's nail. The adhesive may be such that the ends of the paper cylinder are permanently bonded together such that the nail jacket remains in the cylinder shape when removed from the user's finger, or the adhesive may be an easily releasable adhesive such as that utilized on Post-It® notes which allow the ends of the paper to be attached and reattached many times.

Figure 13:
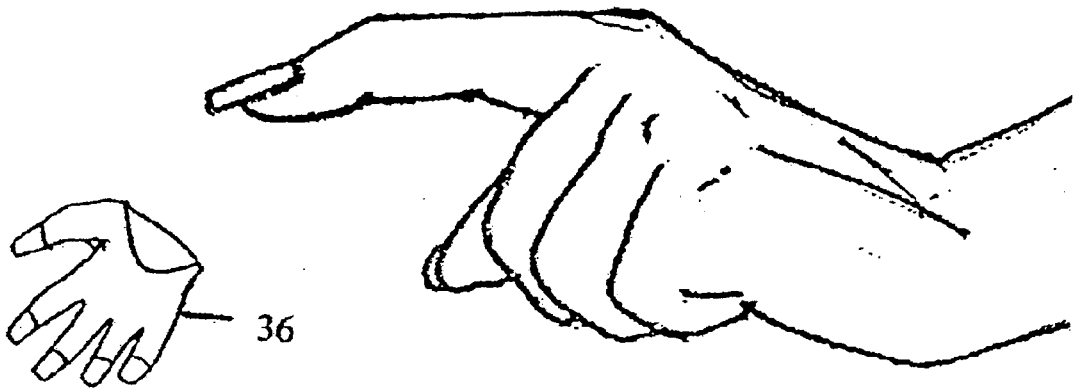
FIG. 13: Is a perspective view of a further embodiment of a Nail Jacket of the present invention.
Figure 14:
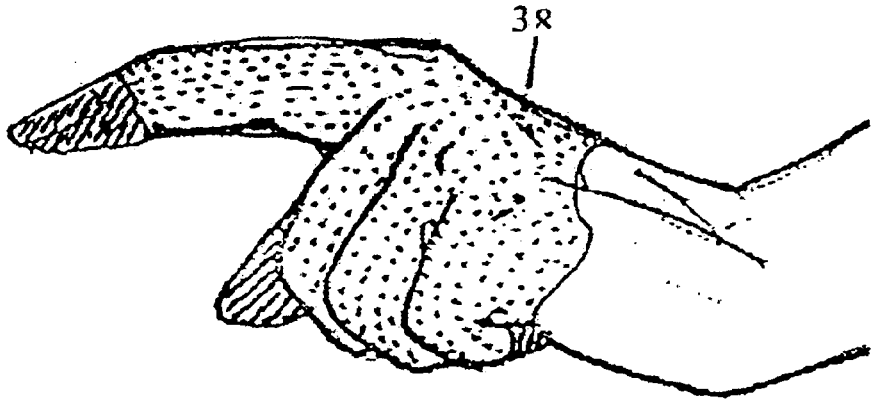
FIG. 14: Illustrates how a nail jacket of the present invention may be attached by a glove which is penetrable by UV light and is perforated to allow air to flow around the hand yet allowing the finger jackets to be held together by a glove for ease of use.

FIGS. 13 and 14 illustrate a further embodiment of a nail jacket of the present invention in which the nail jackets are attached to a glove which is penetrable by UV light and perforated to allow air to flow around the hand, yet allowing the nail jacket to be held on the finger of the user.

Figure 15:
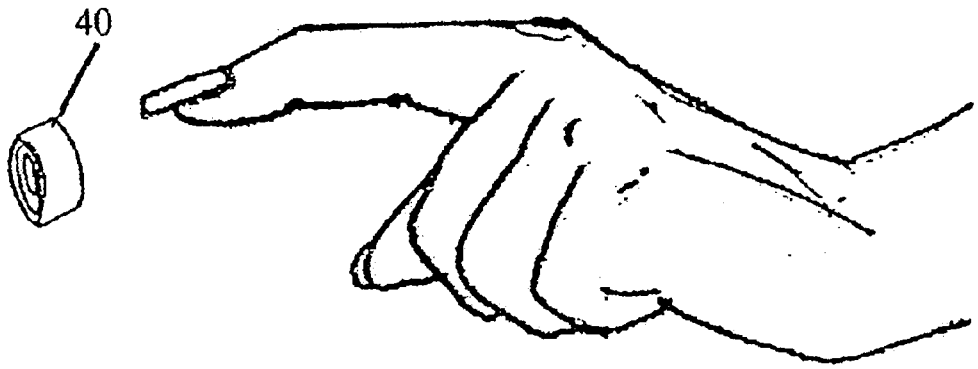
FIG. 15: Is a perspective view of a further embodiment of a Nail Jacket of the present invention.
Figure 16:
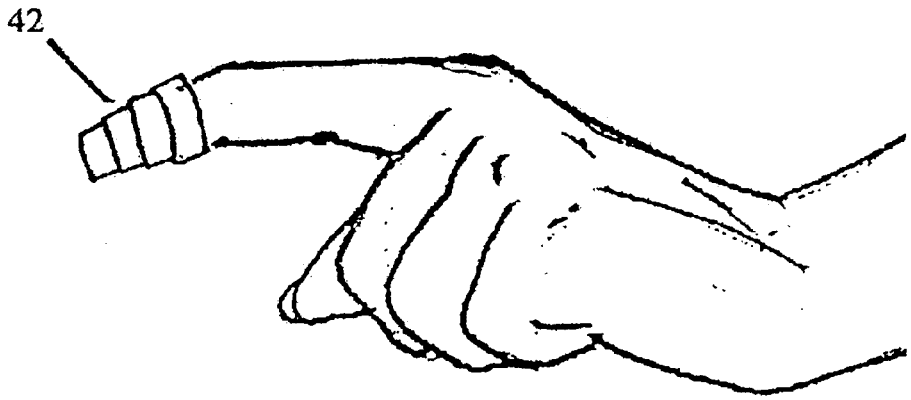
FIG. 16: Illustrates a further embodiment of a nail jacket that is composed of a series of cones that expand telescopically when placed over the users nail, thereby shielding it from UV light.

FIGS. 15 and 16 illustrate yet another embodiment of a nail jacket of the present invention. This nail jacket is comprised of a series of cones that expand telescopically when placed over the user's nail, thereby shielding it from UV light.

Figure 17:
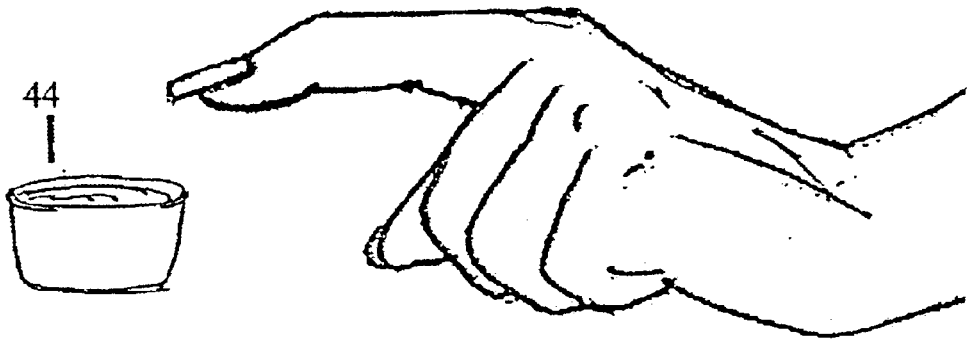
FIG. 17: Is a perspective view of a further embodiment of a Nail Jacket of the present invention.
Figure 18:
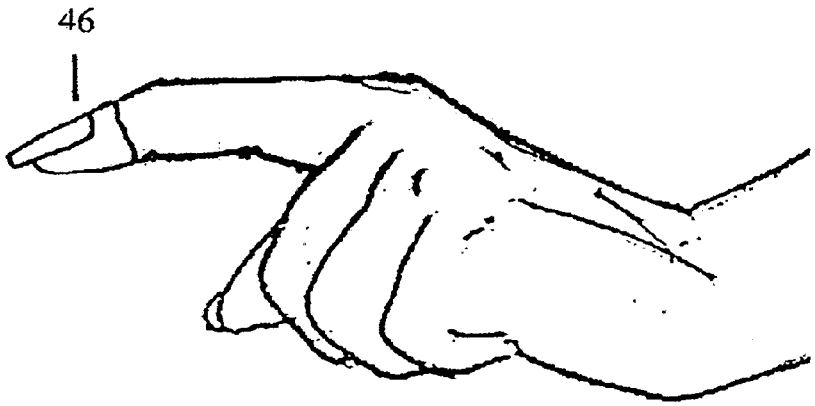
FIG. 18: Shows a further embodiment of a nail jacket of a wax like material (UV resistant) that the user can dip their finger/thumbs into to protect from the effects of UV light.

FIGS. 17 and 18 illustrate a further embodiment of a nail jacket of the present invention. This nail jacket is provided as a liquid material that the user can dip their nails into in which adhere to the nail to provide protection to the nail. For example, the liquid material may be a wax like material containing a UV resistant component that when coated on the tip of the finger of the user, protects the nails from the effect of UV light.

Figure 19:
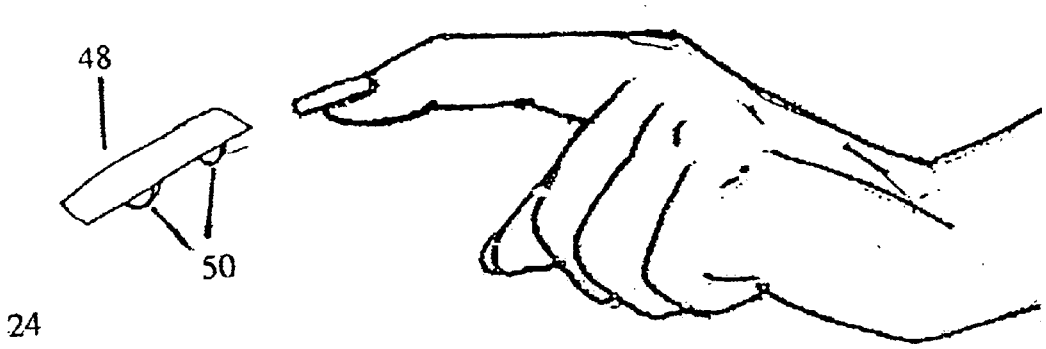
FIG. 19: Is a perspective view of a further embodiment of a Nail Jacket of the present invention.
Figure 20:
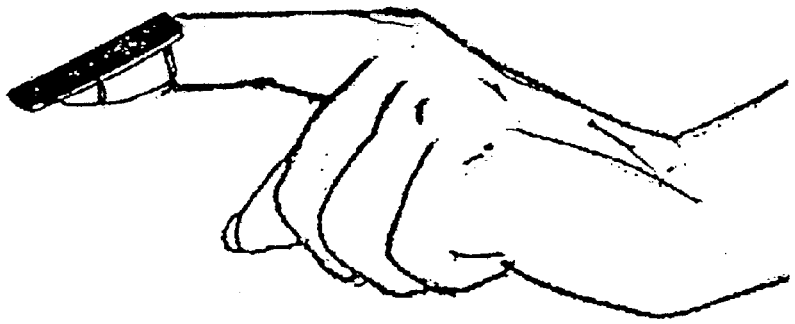
FIG. 20: Illustrates an embodiment of the nail jacket as comprised of a shield that goes over the nail and has one or more rings/hoops on the back which slide over the users finger to hold in place.

FIGS. 19 and 20 illustrate yet a further embodiment of a nail jacket of the present invention. This embodiment of the nail jacket 24 has a top surface or shield 48 having one or more ring or hoops 50 on the back. The user places the end of the finger through the rings or hoops 50 which hold the shield 48 in the proper position on top of the nail.

Figure 21:
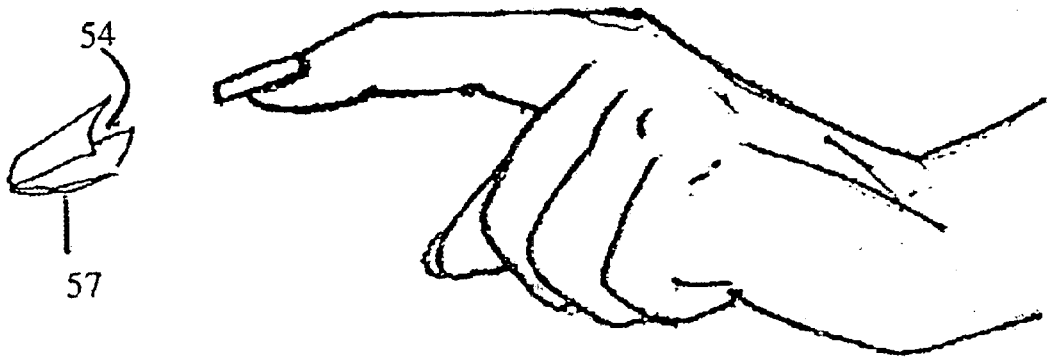
FIG. 21: Is a perspective view of a further embodiment of a Nail Jacket of the present invention.
Figure 22:
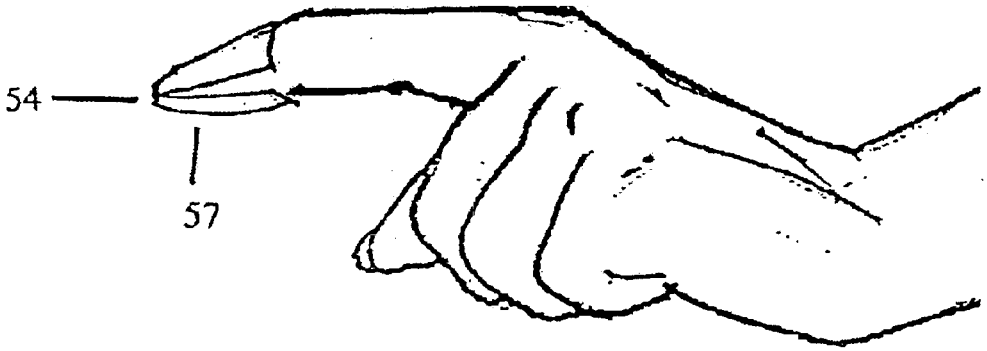
FIG. 22: Shows a further embodiment of a nail jacket which is rubber or plastic construction in which the plastic or other material that is bent at the end forms a joint at the end thereby allowing the nail jacket to slide and expand on the users finger.

FIGS. 21 and 22 illustrate yet another embodiment of a nail jacket according to the present invention, which is constructed of a top and bottom membrane resiliently connected together at one end and having an opening at the second end. The user inserts the finger into the open end which separates the top and bottom and the nail jacket is held on the end of the user by the biasing of the two resilient pieces.

Figure 23:
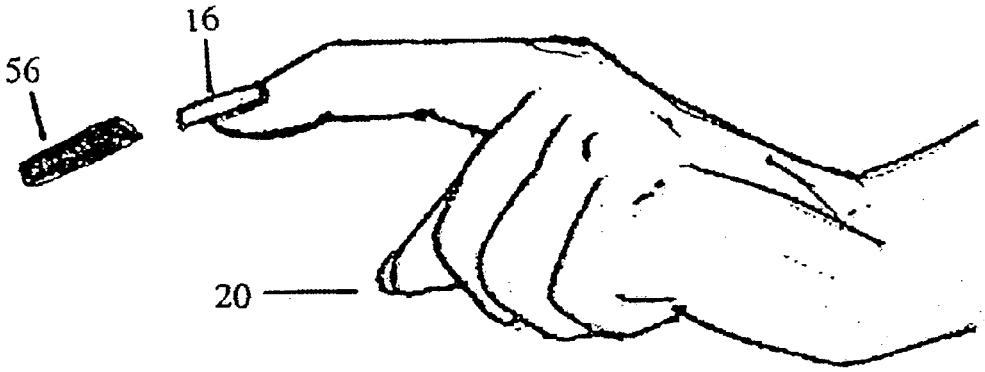
FIG. 23: Is a perspective view of a further embodiment of a nail jacket of the present invention.
Figure 24:
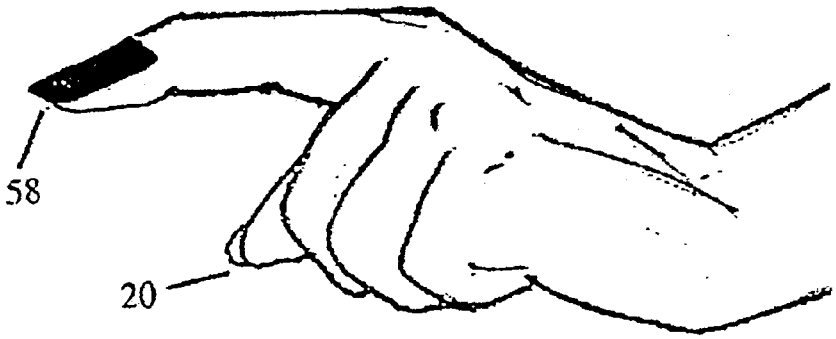
FIG. 24: Shows an embodiment of a nail jacket covering the nail and held in place by an adhesive on the back of the nail jacket.

FIGS. 23 and 24 illustrate a further embodiment of a nail jacket of the present invention which is constructed of a covering 56 of the size to cover the user's nail. The nail jacket is provided with adhesive on the back of the nail jacket that releasably attaches the jacket to the user's fingernail.

Figure 25:
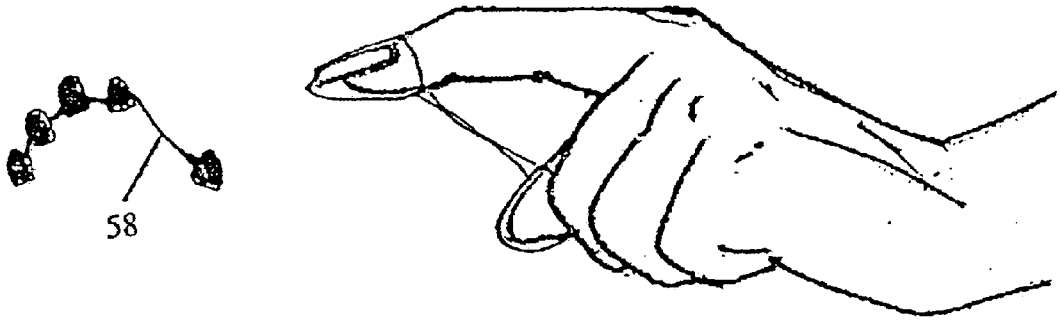
FIG. 25: Is a perspective view of a further embodiment of a nail jacket of the present invention.
Figure 26:
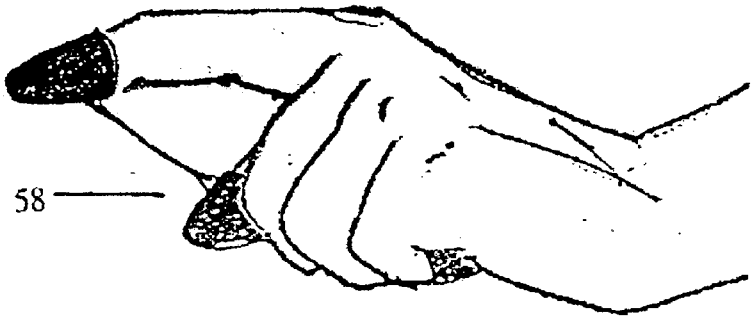

FIGS. 25 and 26 illustrate yet a further embodiment of the nail jacket of the present invention in which the nail jacket comprises a plurality of individual nail jackets of a thimble like structure that fit over the ends of the user's nail. Each of the individual nail jackets is joined to one another by a resilient web material to maintain the nail jackets in the proper position for attachment to the user's finger.

Figure 27:
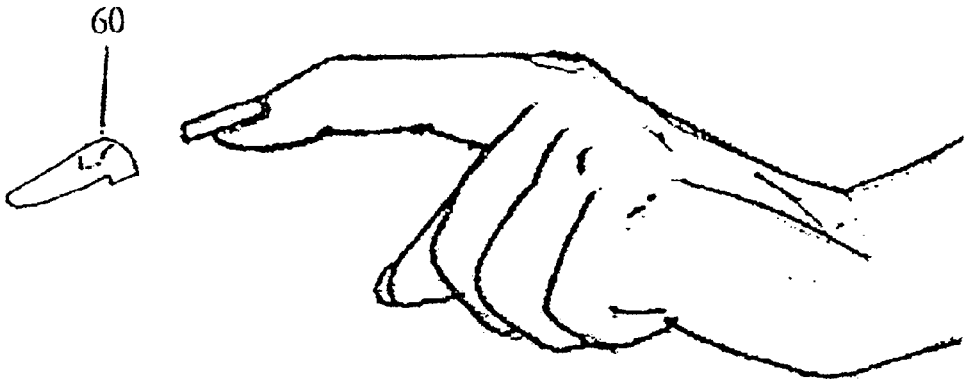
FIG. 27: Is a perspective view of a further embodiment of a nail jacket of the present invention.
Figure 28:
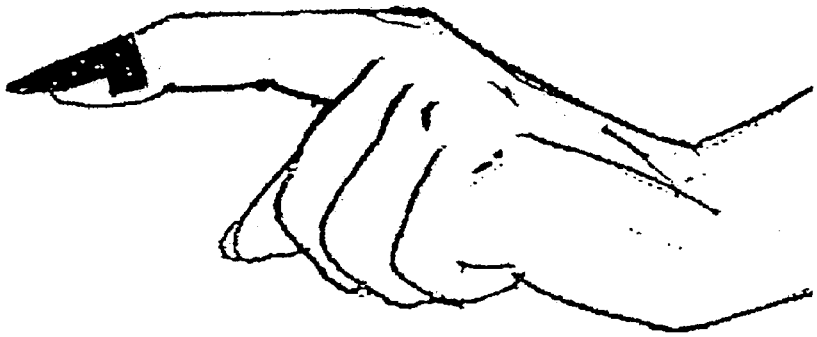
FIG. 28: Illustrates an embodiment of a nail jacket of a clip on style. The nail jacket covers the nail and is held on by a "c" clamp at the base of the nail jacket.

FIGS. 27 and 28 illustrates yet a further embodiment of the nail jacket of the present invention which is a clip on style having a cover to cover the nail and a partial sea clamp at the base of the cover to partly encircle the end of the user's finger.

Figure 29:
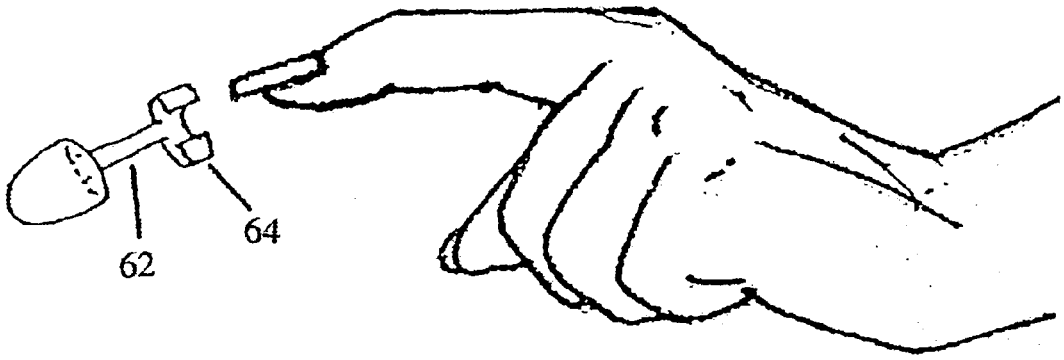
FIG. 29: Is a plane view of a further embodiment of a nail jacket of the present invention.
Figure 30:
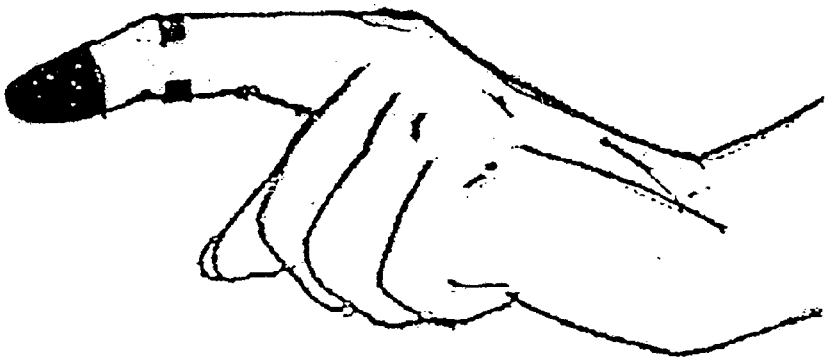
FIG. 30: Illustrates an embodiment of a nail jacket with a "c" clamp of which the band runs along the side of the users finger/thumb.

FIGS. 29 and 30 illustrates yet another embodiment of a nail jacket of the present invention in which the cover for the nail has a thimble like structure with a band extending rearwardly from the open end of the thimble like structure. The distal end of the band is provided with the sea clamp which partially encircles the user's finger to hold the nail jacket in proper orientation.

The nail jacket of the present invention protects artificial and natural nails from yellowing by shielding the nail with a cup or other device, which by covering the nail protects it from UV light thereby preventing the nail from yellowing.

These nail jackets of the present invention may be constructed of any suitable material such as metal, rubber, plastic, paper, resigns, wood, cardboard etc. They are easily handled and stored.

While this invention has been described in detail it is not limited to the exact embodiments shown which are to serve merely as illustrative embodiments of the invention and not by way of limitation.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A method of protecting artificial nails from yellowing or discoloration during exposure to ultraviolet light, the method comprising:

attaching an artificial nail to each of a natural nail of a finger of a human hand releasably attaching to each of a terminal phalanx of each of the fingers of the human hand a nail shielding device of a resilient ultraviolet resistant and opaque material prior to exposure to ultraviolet light, each nail shielding device being generally cup shaped having a first open end into which the terminal phalanx is inserted and having a second closed end to encompass the terminal phalanx of one finger and hold the terminal phalanx snugly due to the resilient nature of the material and fit on the finger.

* * * * *

UNITED STATES PATENT AND TRADEMARK OFFICE

CERTIFICATE OF CORRECTION

PATENT NO. : 6,662,807 B2
DATED : December 16, 2003
INVENTOR(S) : Paul Meinschenk It is certified that error appears in the above-identified patent and that said Letters Patent is hereby corrected as shown below:

Title page,
Item [76] and Item [12], Inventor, should read -- Paul Meinschenk --.

Signed and Sealed this

Eighteenth Day of October, 2005

JON W. DUDAS
*Director of the United States Patent and Trademark Office*